US005474623A

United States Patent [19]

Ma et al.

[11] Patent Number: 5,474,623

[45] Date of Patent: Dec. 12, 1995

[54] MAGNETICALLY ANISOTROPIC SPHERICAL POWDER AND METHOD OF MAKING SAME

[75] Inventors: Bao-Min Ma, Robbinsville; Wan-Li Liu, East Windsor; Yu-Lan Liang, Princeton Jct., all of N.J.

[73] Assignee: Rhone-Poulenc Inc., Cranbury, N.J.

[21] Appl. No.: 69,276

[22] Filed: May 28, 1993

[51] Int. Cl.[6] ..... H01F 1/06

[52] U.S. Cl. ..... 148/101; 148/104; 148/105

[58] Field of Search ..... 148/101, 104, 148/105

[56] References Cited

U.S. PATENT DOCUMENTS

| | | | |
|---|---|---|---|
| 4,402,770 | 6/1983 | Koon | 148/302 |
| 4,576,640 | 3/1986 | Wootton et al. | 420/900 |
| 4,981,532 | 1/1991 | Takeshita et al. | 148/302 |
| 5,069,713 | 12/1991 | Harris et al. | 75/232 |
| 5,127,970 | 7/1992 | Kim | 148/105 |
| 5,143,560 | 9/1992 | Doser | 148/105 |
| 5,314,548 | 5/1994 | Panchanathan et al. | 148/105 |

FOREIGN PATENT DOCUMENTS 0516264 12/1992 European Pat. Off. .

OTHER PUBLICATIONS

I. R. Harris and P. J. McGuinness, "Hydrogen: its use in the processing of NdFeB–type magnets and in the characterization of NdFeB–type alloys and magnets," Proceedings of the Eleventh International Workshop on Rare Earth Magnets and their Applications, Oct. 1990, Carnegie Mellon University Press, Pittsburgh, Pa., pp. 29–48.

Patent Abstracts of Japan, vol. 17, No. 19, 3 Sep. 1992, 04–247604.

Patent Abstracts of Japan, vol. 13, No. 435, 26 Jun. 1989, 01–162302.

*Primary Examiner*—George Wyszomierski

*Attorney, Agent, or Firm*—Adduci, Mastriani, & Schaumberg

[57] ABSTRACT

A method of forming a magnetically anisotropic powder includes the steps of forming a substantially spherical powder having a major magnetic phase and an average particle size of less than about 200 microns, diffusing hydrogen into the spherical powder at elevated temperatures in an amount sufficient to disproportionate the major magnetic phase, and desorbing the hydrogen by heating the disproportionated powder under vacuum. The magnetic material from which the spherical powder is formed may be a rare earth-transition metal-boron alloy including at least one element from the iron group, at least one rare earth element, and boron. A method of forming a bonded magnet containing magnetically anisotropic particles further includes the steps of mixing the dehydrogenated powder with a binder to form a mixture, and aligning and magnetizing the powder particles in the mixture in a magnetic field. Bonded magnets containing spherical, magnetically anisotropic particles of the invention have intrinsic coercivities in excess of 7 kOe.

22 Claims, 11 Drawing Sheets

MAGNETICALLY ANISOTROPIC SPHERICAL POWDER AND METHOD OF MAKING SAME

FIELD OF INVENTION

The present invention relates to magnetic materials exhibiting high intrinsic coercivity and, more particularly, to such materials in powder form.

BACKGROUND OF THE INVENTION

The magnetic properties of rare earth-transitional metal-boron alloys such as NdFeB-type alloys are well known to those in the art. One of the applications in which NdFeB alloys are used is the production of bonded magnets. Bonded magnets consist of magnetic particles agglomerated in a binder, such as an organic polymer, and exhibit strong magnetic properties.

NdFeB alloy powders for use in the production of bonded magnets have been commercially prepared by crushing melt-spun ribbons into powder. The flake-like particles formed by crushing melt-spun ribbons generally exhibit isotropic behavior and relatively poor flowability. Consequently, they do not achieve their full potential as magnetic materials and are somewhat difficult to form into bonded magnets using conventional injection molding equipment. In addition, the mechanical strength of bonded magnets formed of such flake-like particles is relatively poor because of stress concentrations arising from the sharp edges of the flake-like particles.

NdFeB alloy powders have been prepared by crushing and pulverizing cast ingots of NdFeB alloys. Powders prepared in this manner typically display intrinsic coercivity, $H_{ci}$, values of less than 5 kOe because of their large-grained microstructures formed during relatively slow cooling and metallurgical defects or oxidation on the particle surfaces. As a consequence of the low $H_{ci}$ values they display, crushed and pulverized NdFeB alloy powders have not been used in the preparation of bonded magnets.

Hydrogen processing of NdFeB alloys in ingot and powder form is described in U.S. Pat. No. 4,981,532, to *Takeshita* et al. and a publication by I. R. Harris and P. J. McGuiness ("Hydrogen: its use in the processing of NdFeB-type magnets and the characterization of NdFeB-type alloys and magnets," Proceedings of the Eleventh International Workshop on Rare Earth Magnets and Their Applications, October 1990, Carnegie Mellon University Press, Pittsburgh, Pa.). Using a technique known as hydrogen disproportionation, desorption, and recombination (HDDR), coercive NdFeB alloy powders have been prepared by heating an NdFeB alloy in a hydrogen atmosphere and removing the hydrogen in a desorption step. Powders prepared by subjecting a cast NdFeB alloy, either in ingot or powder form, to HDDR have irregularly shaped, i.e. non-spherical, particles with the shape of the particles varying depending upon the fracture patterns in the alloy. Generally, NdFeB powders prepared by subjecting a cast alloy to HDDR are isotropic, although some anisotropic behavior has been noted for cast alloys containing a refractory metal addition such as Nb, Ti, Zr, or Hf.

It is known that spherical NdFeB alloy powders can be produced using gas atomization. In principle, a spherical powder morphology is well suited for use in the production of bonded magnets because the relatively high flowability of spherical powders is conducive to injection molding. Furthermore, the mechanical strength of bonded magnets formed from spherical particles should be high because the spherical shape of the particles minimizes the possibility that stress concentrations from sharp-edged particles will occur during bending. Nevertheless, spherical NdFeB alloy powders produced by gas atomization have not been widely used in the production of bonded magnets because they display low $H_{ci}$ values.

A method for improving the intrinsic coercivity of relatively coarse spherical NdFeB alloy powder produced by gas atomization is disclosed in U.S. Pat. No. 5,127,970, to Kim. The method involves subjecting a spherical NdFeB alloy powder having a particle size within the range of 200–300 microns to dual hydrogen absorption-desorption treatment cycles at an elevated temperature in the range of 660° C. to 850° C. While the intrinsic coercivity of the NdFeB powder is enhanced, the nature of the powder remains isotropic. Thus, the enhanced remanence ($B_r$) and maximum energy product ($BH_{max}$) desired for commercial applications, which result from anisotropic behavior, are not realized.

Accordingly, it is the primary object of the present invention to provide a spherical magnetic particle that is magnetically anisotropic.

An additional object of the invention is to provide a magnetic material of high intrinsic coercivity. A further object of the invention is to provide a bonded magnet formed from anisotropic spherical particles having a high coercivity per particle.

Additional objects and advantages of the invention will be set forth in part in the description which follows, and in part will be obvious from the description, or may be learned by practice of the invention.

SUMMARY OF THE INVENTION

To achieve the objects and in accordance with the purpose of the invention, as embodied and broadly described herein, the method of forming a magnetically anisotropic powder of the invention includes forming a substantially spherical powder having a major magnetic phase and an average particle size of less than about 200 microns, diffusing hydrogen into the spherical powder at elevated temperatures in an amount sufficient to disproportionate the major magnetic phase, and desorbing the hydrogen by heating the disproportionated powder under vacuum. The disproportionated powder retains its spherical shape and is magnetically anisotropic, exhibiting a reasonably high intrinsic coercivity and maximum energy product. The spherical, magnetically anisotropic powder can be mixed with a binder and processed into a bonded magnet.

The magnetic material from which the spherical powder is formed may be comprised of a rare earth-transition metal-boron alloy including at least one element from the iron group, at least one rare earth element, and boron. The major magnetic phase of the spherical powder preferably consists essentially of $(Nd_{1-x}R_x)_2 Fe_{14}B$, where R is one or more of La, Sm, Pr, Dy, Tb, Ho, Er, Tm, Yb, Lu, and Y, and x is from 0 to 1. A preferred range for the average particle size of the spherical powder is from about 10 microns to about 150 microns.

The disproportionation and desorption steps may be carried out at elevated temperatures in the range from 500° C. to 1000° C., and preferably in the range from about 900° C. to about 950° C. In a preferred embodiment, the method also includes the step of heating the dehydrogenated powder to increase the intrinsic coercivity of the powder.

Another aspect of the invention is a method of forming a bonded magnet consisting essentially of magnetically anisotropic powder. The method of forming a magnet includes forming a substantially spherical powder having a major magnetic phase and an average particle size of less than about 200 microns by inert gas atomization, diffusing hydrogen into the spherical powder at elevated temperatures in an amount sufficient to disproportionate the major magnetic phase, desorbing hydrogen by heating the disproportionated powder under vacuum, mixing the dehydrogenated powder with a suitable binder to form a mixture comprised of powder particles dispersed in the binder, and aligning and magnetizing the powder particles in the mixture in a magnetic field.

A further aspect of the invention is a bonded magnet formed of spherical, magnetically anisotropic particles. The bonded magnet includes a plurality of substantially spherical particles consisting essentially of at least one element from the iron group, at least one rare earth element, and boron. The spherical particles are magnetically anisotropic, magnetized, and aligned. A binder agglomerates the spherical particles into a bonded magnet having an intrinsic coercivity in excess of 7 kOe. In a preferred embodiment, recrystallized grains in the spherical powder particles subdivide the powder particles into individual magnetic domains having an average size of less than 0.5 micron.

It is to be understood that the foregoing general description and the following detailed description are exemplary and explanatory only and are not restrictive of the invention, as claimed.

BRIEF DESCRIPTION OF DRAWINGS

The accompanying drawings, which are incorporated in and constitute a part of this specification, illustrate several exemplary embodiments of the invention and together with the description serve to explain the principles of the invention.

DESCRIPTION OF THE PREFERRED EMBODIMENTS

Figure 1:
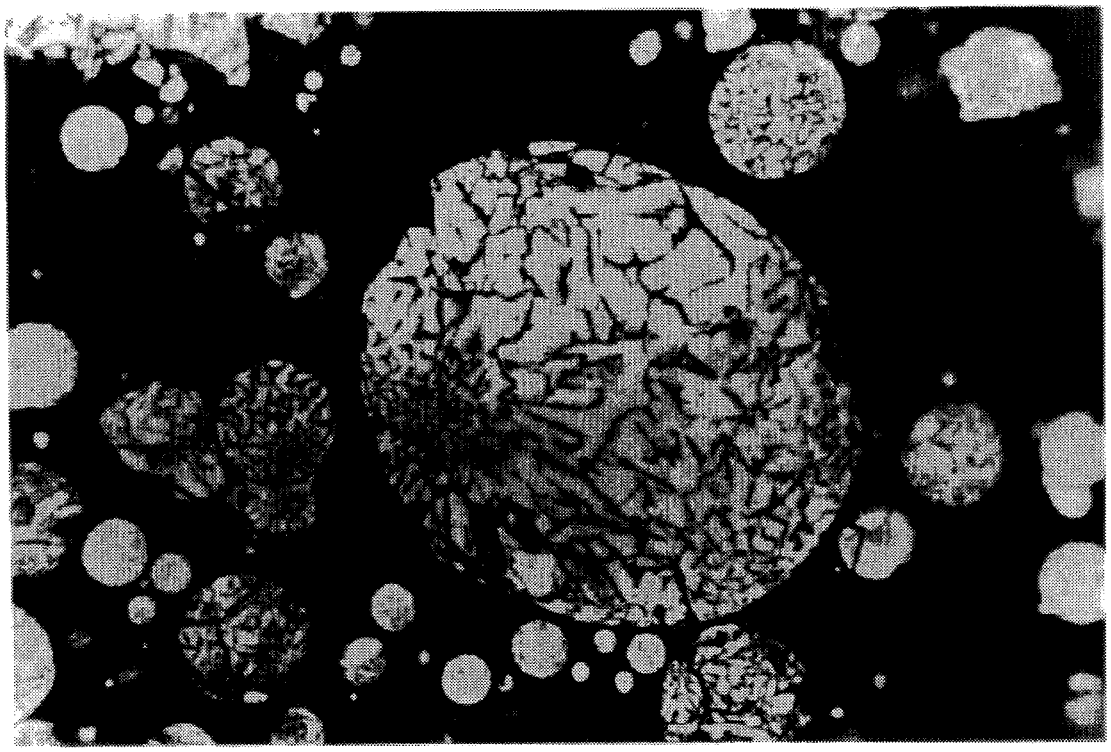
FIG. 1 is a 500 X optical micrograph of $Nd_{12.6}Dy_{1.4}Fe_{79}Nb_{0.5}B_{6.5}$ (Batch H) powder showing the spherical shape of the particles in the as-atomized state. The relatively large grain size of the particles varies with particle diameter.

Reference will now be made in detail to the present preferred embodiments of the invention, examples of which are illustrated in the accompanying drawings.

The method of forming a magnetically anisotropic powder of the invention includes forming a substantially spherical powder having a major magnetic phase and an average particle size of less than about 200 microns. Magnetic materials of the NdFeB-type are suitable for use in the invention. It is preferred that the spherical powder is comprised of at least one element from the iron group, at least one rare earth element, and boron. The element from the iron group may be Fe, Ni, Co, or mixtures thereof. The rare earth element may be selected from the lanthanide group including Nd, La, Sm, Pr, Dy, Tb, Ho, Er, Tm, Yb, Lu, Y, mixtures thereof, and mischmetal.

Substantially spherical powder having an average particle size of less than about 200 microns, and preferably less than about 150 microns, may be formed by known techniques including, but not limited to, inert gas atomization, plasma spray, and in-flight solidification. A preferred range for the average particle size of the spherical powder is from about 10 microns to about 150 microns. A more preferred range for the average particle size of the spherical powder is from about 10 microns to about 70 microns.

In connection with the description of the invention, the term "major magnetic phase" means the phase of a magnetic material that most contributes to the magnetic properties of the material. It is preferred that the major magnetic phase of the spherical powder consists essentially of $(Nd_{1-x}R_x)_2Fe_{14}B$, where R is one or more of La, Sm, Pr, Dy, Tb, Ho, Er, Tm, Yb, Lu, and Y, and x is from 0 to 1. In a preferred embodiment, the major magnetic phase of the spherical powder consists essentially of tetragonal $Nd_2Fe_{14}B$.

In accordance with the invention, hydrogen is diffused into the spherical powder at elevated temperatures in an amount sufficient to disproportionate the major magnetic phase. As hydrogen is diffused into the spherical powder, the major magnetic phase undergoes a disproportionation reaction. In powders in which the major magnetic phase is $Nd_2Fe_{14}B$, that phase disproportionates into $NdH_x$, Fe, and $Fe_2B$ phases. The amount of hydrogen required to disproportionate a magnetic phase is described in U.S. Pat. No. 4,981,532, the disclosure of which is hereby incorporated by reference. The hydrogen disproportionation step may be carried out for approximately 1 hour at a temperature in the range from 500° C. to 1000° C. In a preferred embodiment, the hydrogen disproportionation step is carried out for approximately 1 hour at a temperature in the range from about 900° C. to about 950° C.

In accordance with the invention, hydrogen is desorbed from the disproportionated powder by heating under vacuum. As hydrogen is desorbed from the disproportionated powder, the disproportionated phases gradually recombine. In powders in which the major magnetic phase is $Nd_2Fe_{14}B$, the $NdH_x$, Fe, and $Fe_2B$ phases recombine into $Nd_2Fe_{14}B$. The hydrogen desorption step, which is also described in U.S. Pat. No. 4,981,532, may be carried out for 1–3 hours at a temperature in the range from 500° C. to 1000° C. In a preferred embodiment, the hydrogen desorption step is carried out under vacuum for approximately 1 hour at a temperature in the range from about 900° C. to about 950° C.

Figure 2:
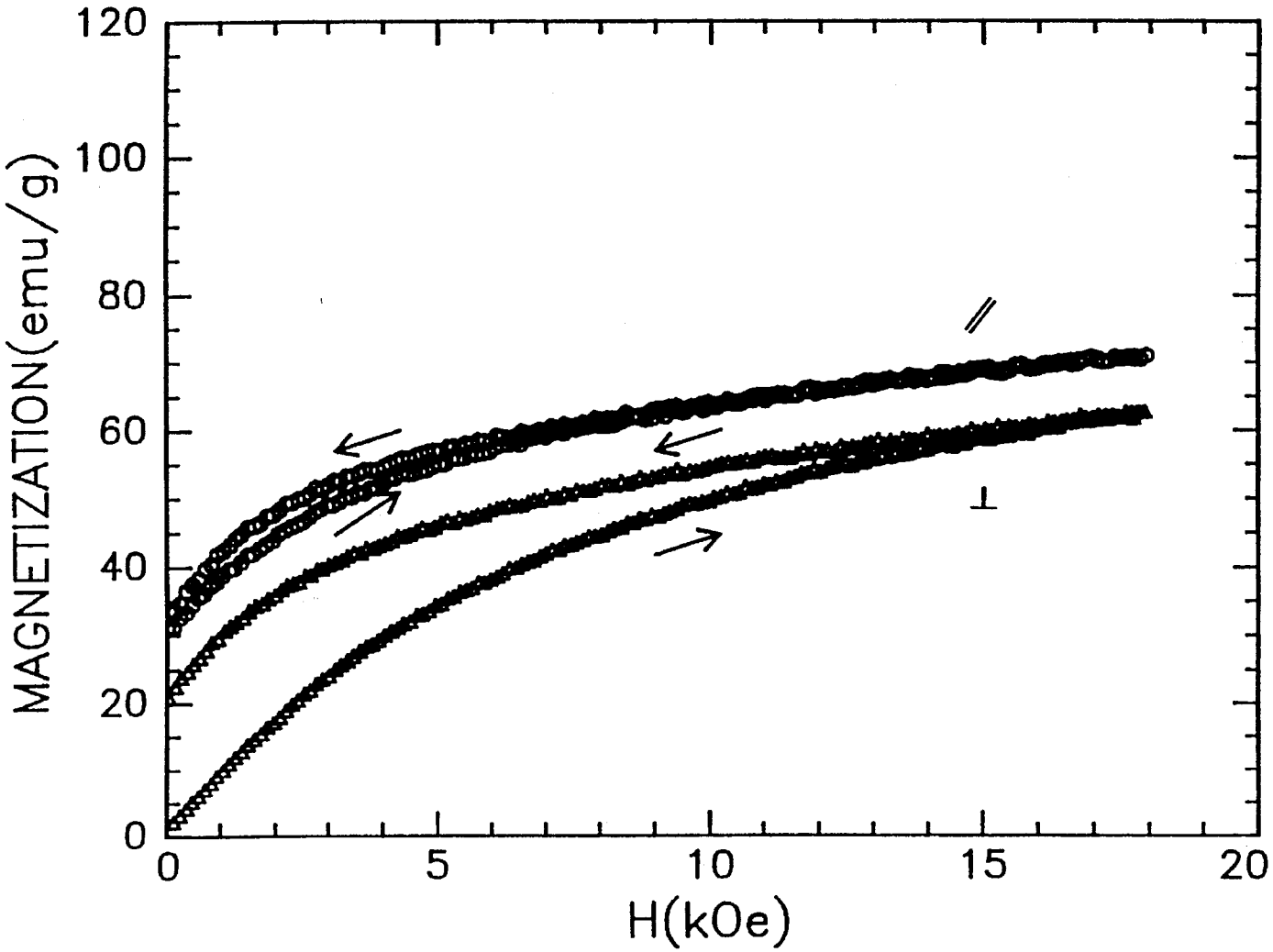
FIG. 2 is a graph of magnetization curves for as-atomized $Nd_{11.7}Dy_{1.3}Fe_{80}Nb_{0.5}B_{6.5}$ (Batch F) powder measured parallel and perpendicular to the original magnetization direction. The as-atomized powders were immersed in molten paraffin and solidified under a DC magnetic field. The measured magnetization was normalized to 100% powder theoretical density. The difference in magnetization at zero magnetic field, $B_r$, between the measured directions is about 10 emu/g, which reflects isotropic behavior.
Figure 3:
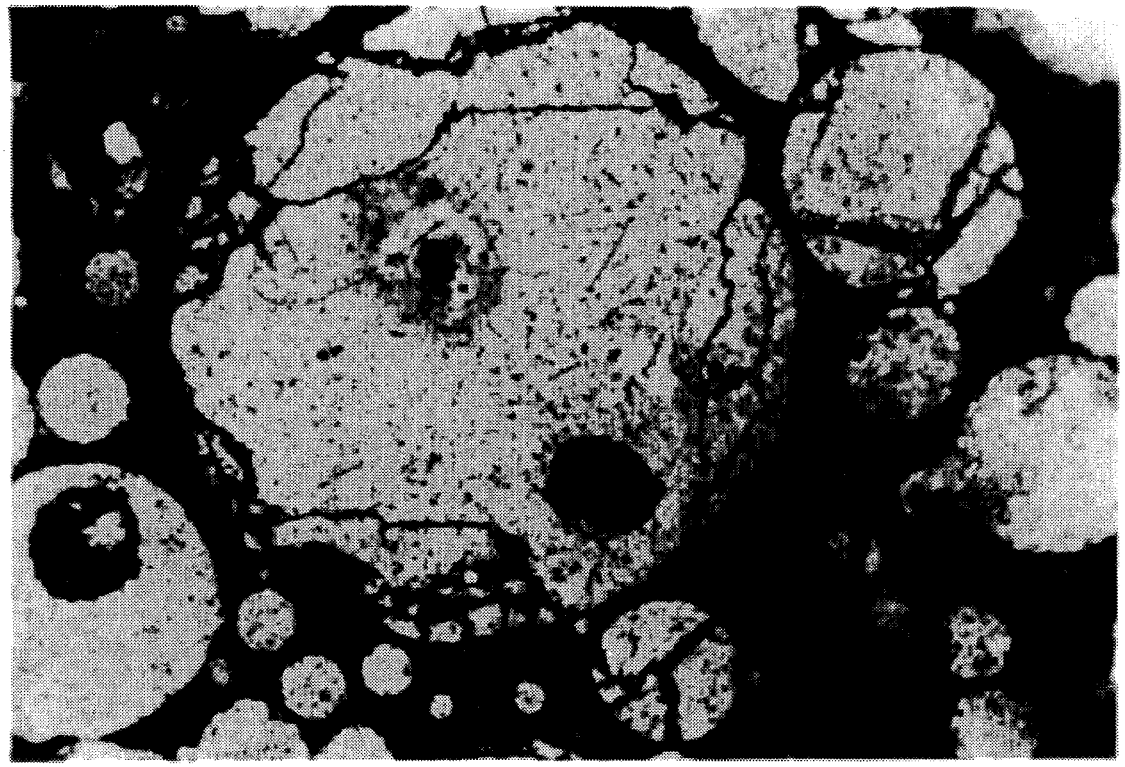
FIG. 3 is a 500 X optical micrograph of $Nd_{12.6}Dy_{1.4}Fe_{79}Nb_{0.5}B_{6.5}$ (Batch H) powder of the present invention formed by inert gas atomization and HDDR treatment. The particles shown in FIG. 3 have undergone grain refinement so that their grain size is beyond the resolution of optical microscopy but otherwise have retained the spherical shape and original particle size of the as-atomized particles shown in FIG. 1.
Figure 4:
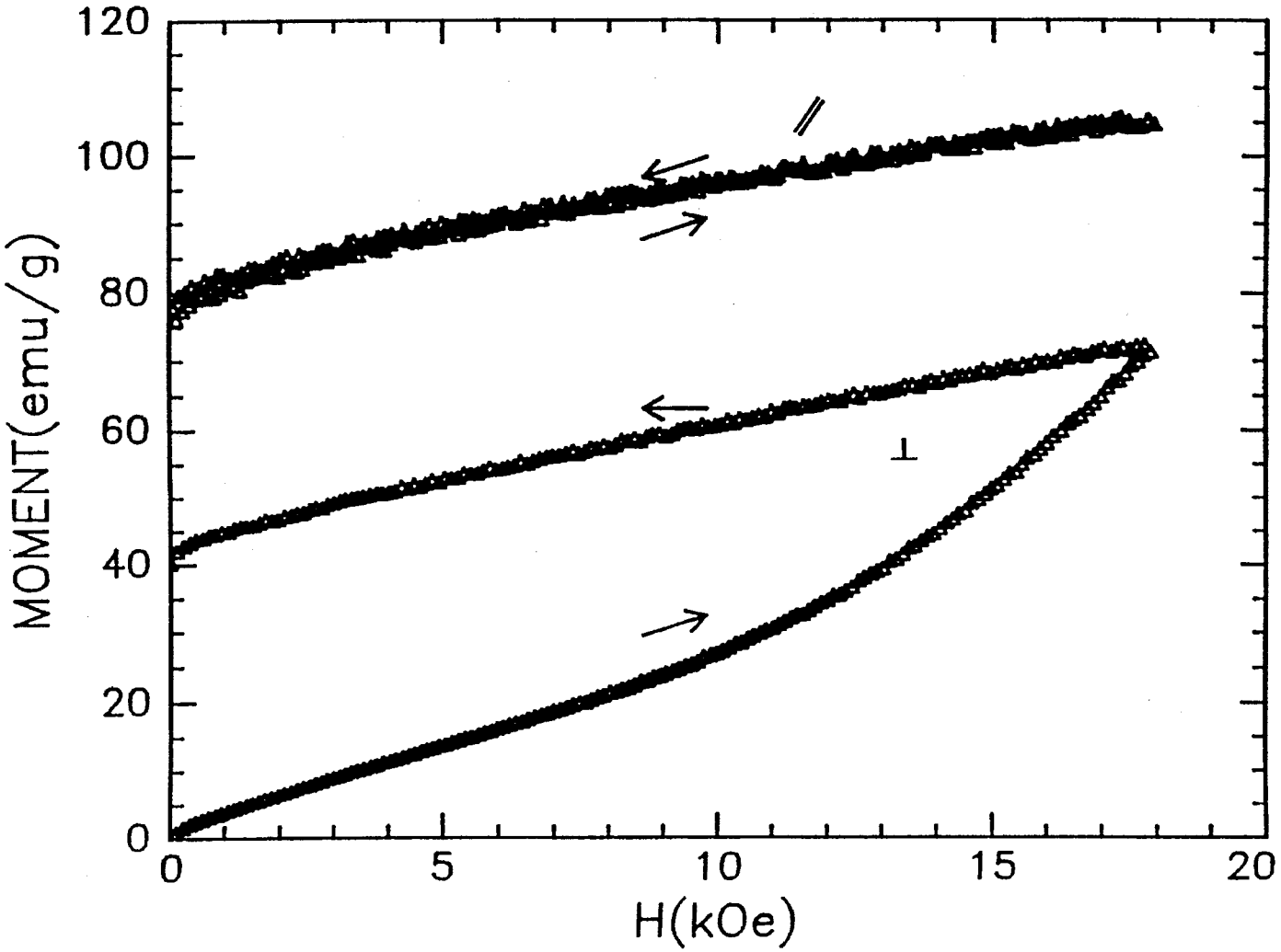
FIG. 4 is a graph of magnetization curves for $Nd_{11.7}Dy_{1.3}Fe_{80}Nb_{0.5}B_{6.5}$ (Batch F) powder of the present invention measured parallel and perpendicular to the original magnetization direction. The difference in magnetization at zero magnetic field between the measured directions is about 40 emu/g, which reflects anisotropic behavior.
Figure 5:
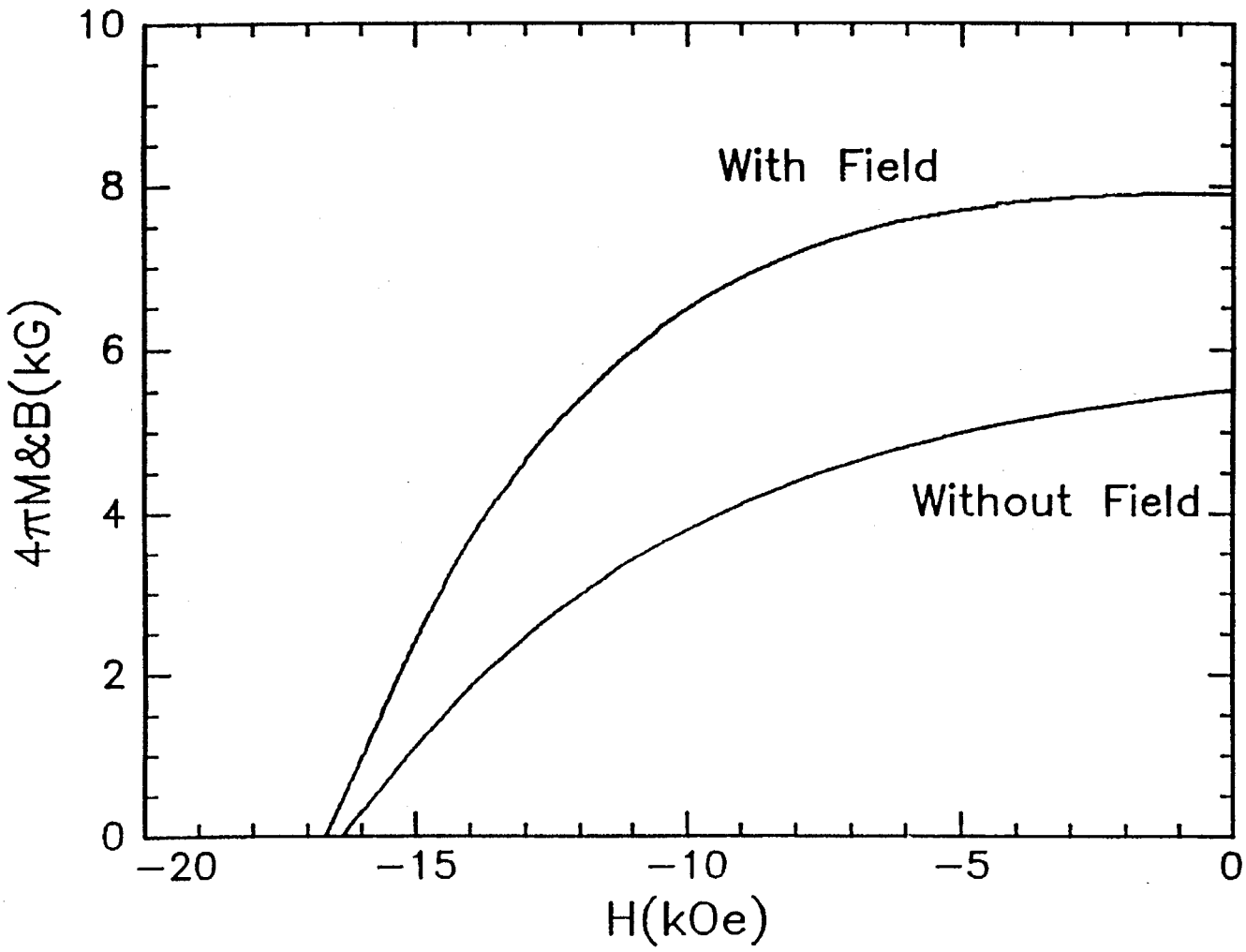
FIG. 5 is a graph of second quadrant demagnetization curves for $Nd_{11.7}Dy_{1.3}Fe_{80}Nb_{0.5}B_{6.5}$ (Batch F) powder of the present invention measured with and without magnetic field alignment. The $B_r$ value for the powder increases from about 5.5 kG without magnetic field alignment to about 7.9 kG with magnetic field alignment.

Powders formed by gas atomization are spherical in shape (see, for example, the powder particles in FIG. 1) and each particle typically consists of many randomly oriented grains. As a consequence of the random grain orientation in each particle, gas atomized NdFeB-type particles are magnetically isotropic in the as-atomized state as demonstrated in FIG. 2. The NdFeB-type particles formed in accordance with the present invention surprisingly retain their spherical shape and original particle size (compare the powder particles in FIG. 3 with those in FIG. 1) and unexpectedly display magnetic anisotropy. FIGS. 4 and 5 are graphs showing magnetization and demagnetization curves, respectively, for spherical powders of the present invention. As can be seen in FIG. 5, the demagnetization curves along directions aligned with and perpendicular to the magnetization direction are significantly different demonstrating that the spherical powders of the present invention are magnetically anisotropic.

If desired, the dehydrogenated powder can be reheated to a temperature of 500° C. to 700° C. to increase the intrinsic coercivity of the powder. For powders in which the major magnetic phase is $Nd_2Fe_{14}B$, one or more refractory elements may be added to the powder to minimize the secondary recrystallization of $Nd_2Fe_{14}B$ grains during thermal treatment. The refractory element(s) may be selected from the 3d or 4d metal groups including Co, Nb, V, Mo, Ti, Zr, Cr, W, and mixtures thereof. In addition, one or more grain boundary modifiers such as Cu, Al, and Ga may be added to increase the coercivity of the powder.

Another aspect of the invention is a method of forming a bonded magnet consisting essentially of magnetically anisotropic powder. The method includes the steps described above in connection with the method of forming a magnetically anisotropic powder, namely forming a substantially spherical powder, diffusing hydrogen into the powder to disproportionate the major magnetic phase, and desorbing the hydrogen by heating the disproportionated powder under vacuum. The method further includes mixing the dehydrogenated powder with a suitable binder to form a mixture comprised of powder particles dispersed in the binder, and aligning and magnetizing the powder particles in the mixture in a magnetic field. Suitable binders include, but are not limited to, organic polymers such as nylon. The mixture of powder particles dispersed in the binder may be formed into a magnet by injection molding, cold compression and curing, or any other suitable process. Those skilled in the art will recognize that the mixing step and the aligning and magnetizing step may be combined into a single step through the use of automated processing equipment.

Bonded magnets comprised of substantially spherical, magnetically anisotropic particles formed in accordance with the invention have intrinsic coercivities in excess of 7 kOe. During HDDR treatment, a plurality of recrystallized grains are formed in the spherical powder particles. In a preferred embodiment, the recrystallized grains subdivide the powder particles into individual magnetic domains having an average size of less than 0.5 micron.

The following examples further illustrate preferred embodiments of the invention. The examples should in no way be considered limiting, but are merely illustrative of the various features of the present invention.

EXAMPLE 1

Four batches of atomized powders having the compositions listed in Table 1 were prepared. The La, Al, and B contents were selected in accordance with the compositional requirements set forth in U.S. Pat. No. 4,402,770, to Koon.

TABLE 1

| | Composition (in weight %) | | | |
|---|---|---|---|---|
| Element | Batch A | Batch B | Batch C | Batch D |
| Nd | 26.66 | 26.70 | 29.56 | 29.56 |
| La | 1.49 | 1.50 | 1.46 | 1.45 |
| Pr | 0.24 | 0.24 | 0.35 | 0.35 |
| Dy | 3.99 | 4.00 | 0.56 | 0.55 |
| Al | 0.36 | 0.36 | 0.40 | 0.41 |
| B | 1.32 | 1.34 | 1.38 | 1.39 |
| Total Rare Earth | 32.38 | 32.44 | 31.93 | 31.91 |
| Fe | Balance | Balance | Balance | Balance |

Figure 6:
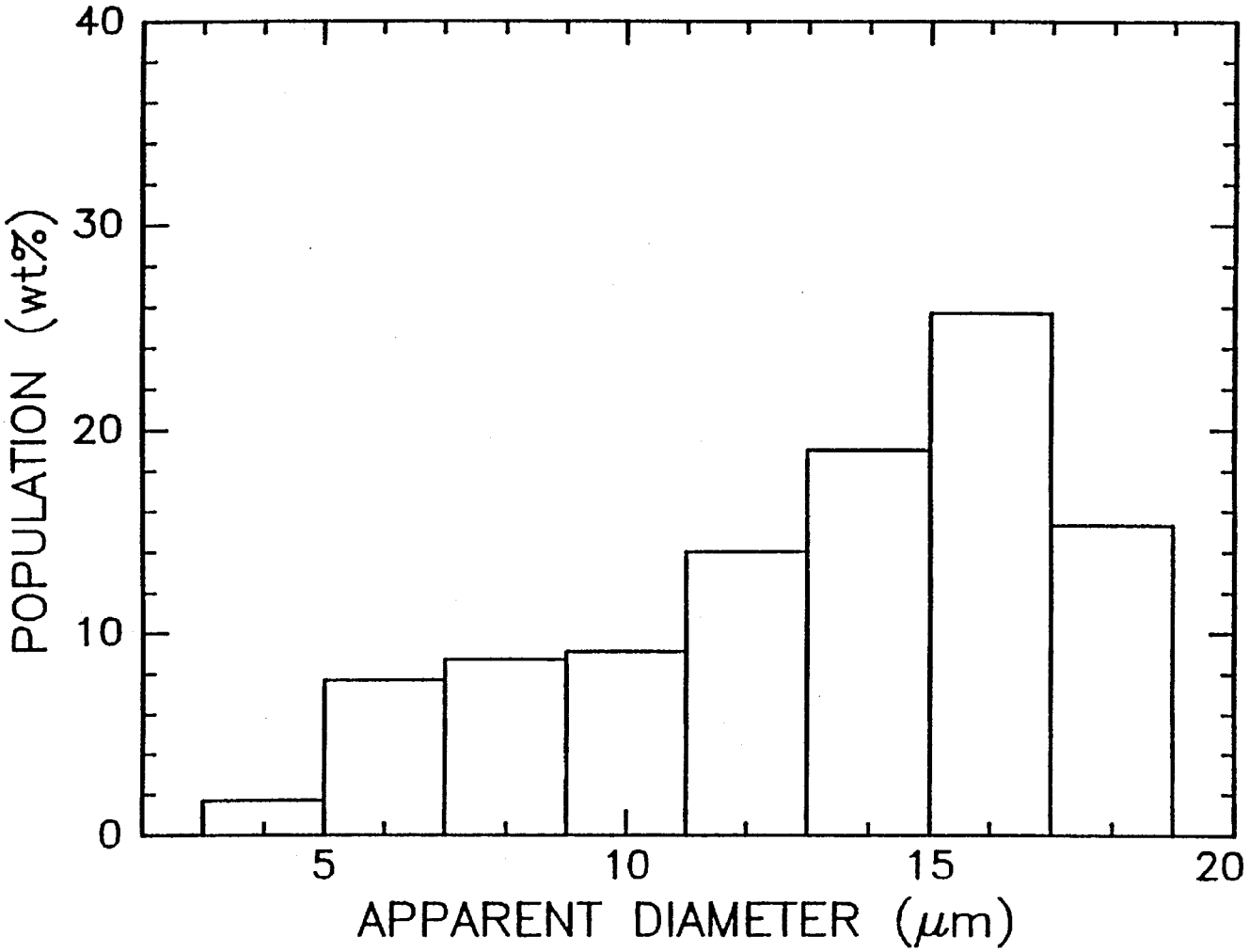
FIG. 6 is a bar graph showing the particle size distribution for the powders of Batches A and D in Example 1.
Figure 7:
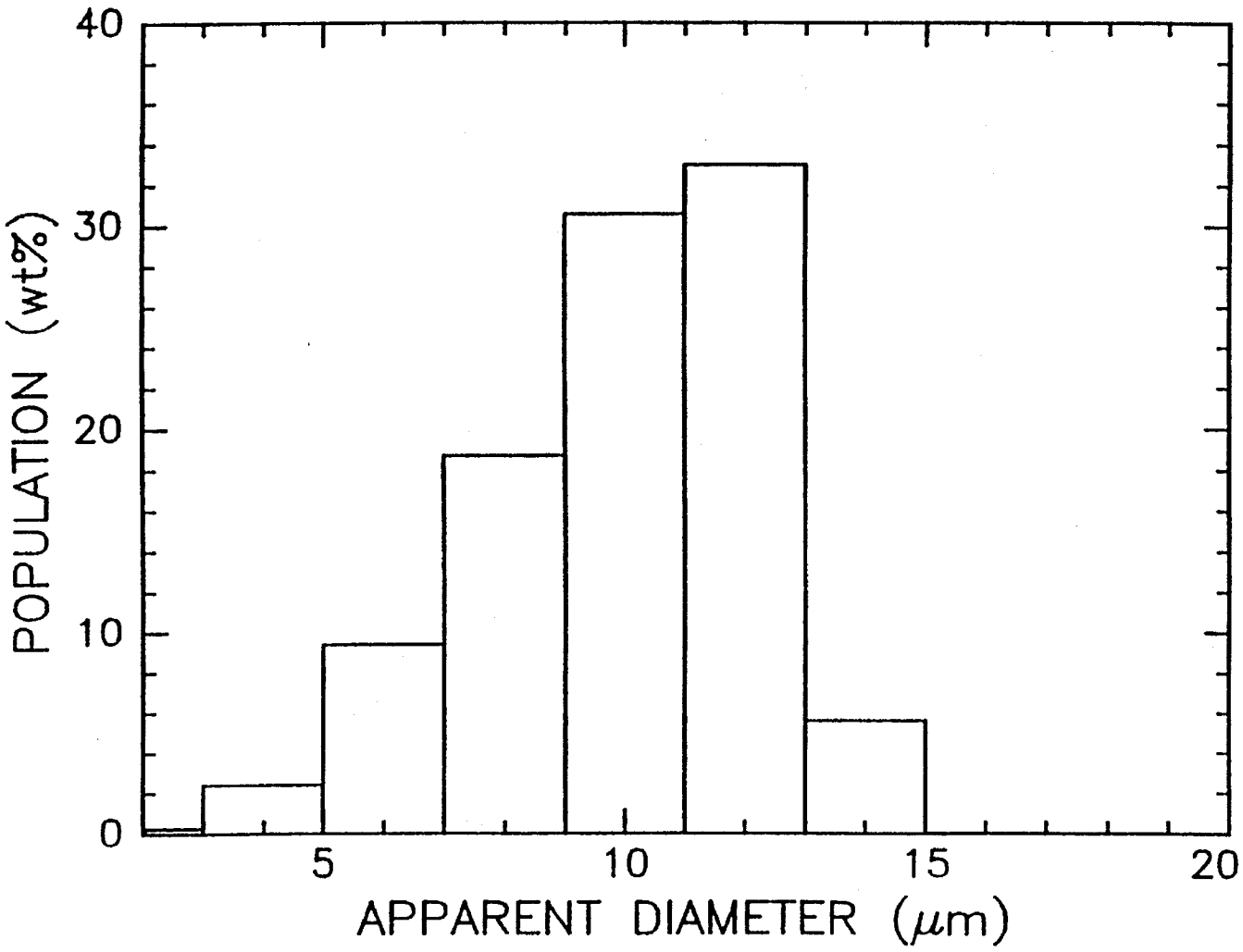
FIG. 7 is a bar graph showing the particle size distribution for the powders of Batches B and C in Example 1.
Figure 8:
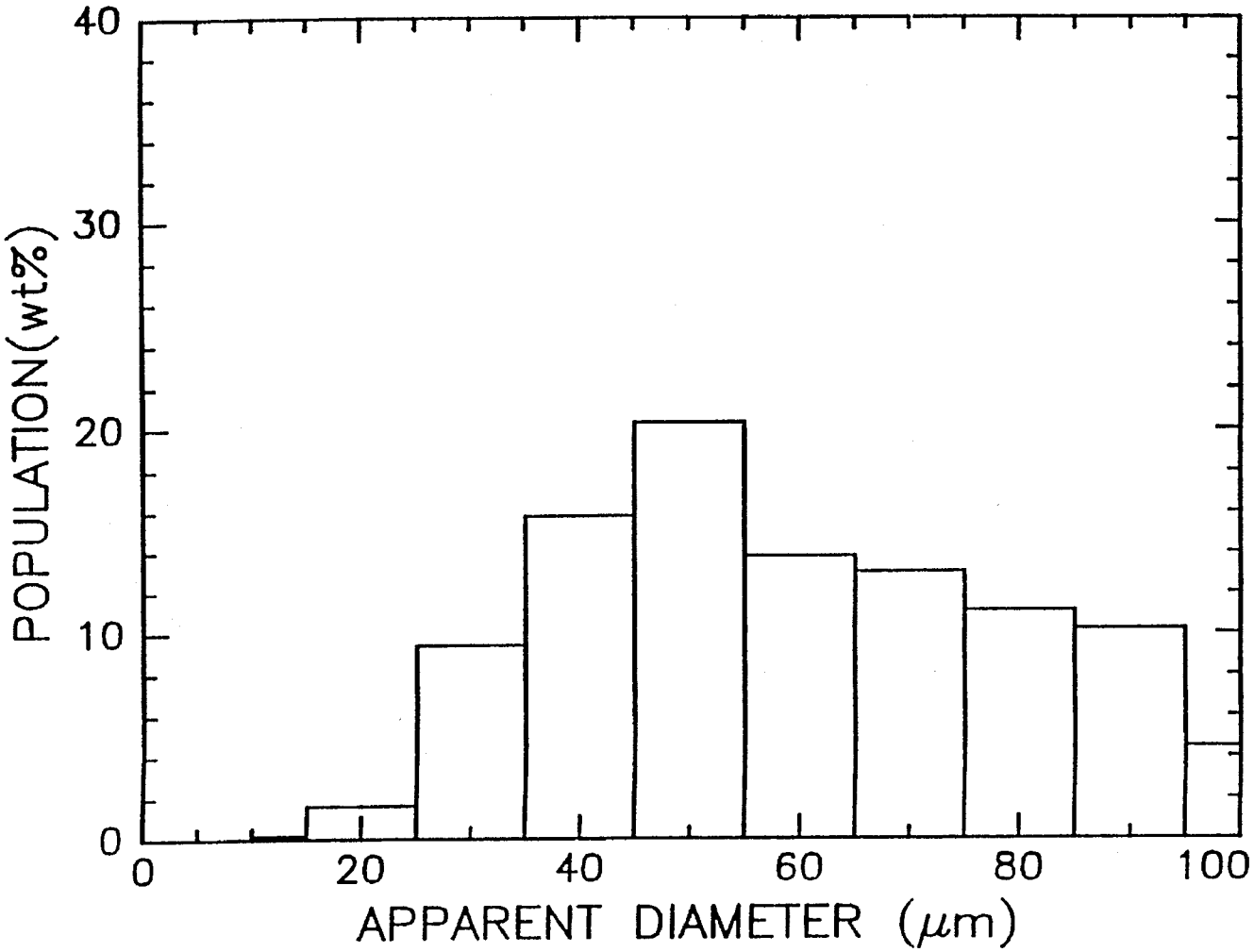
FIG. 8 is a bar graph showing the particle size distribution for the powder of Batch E in Example 2.
Figure 9:
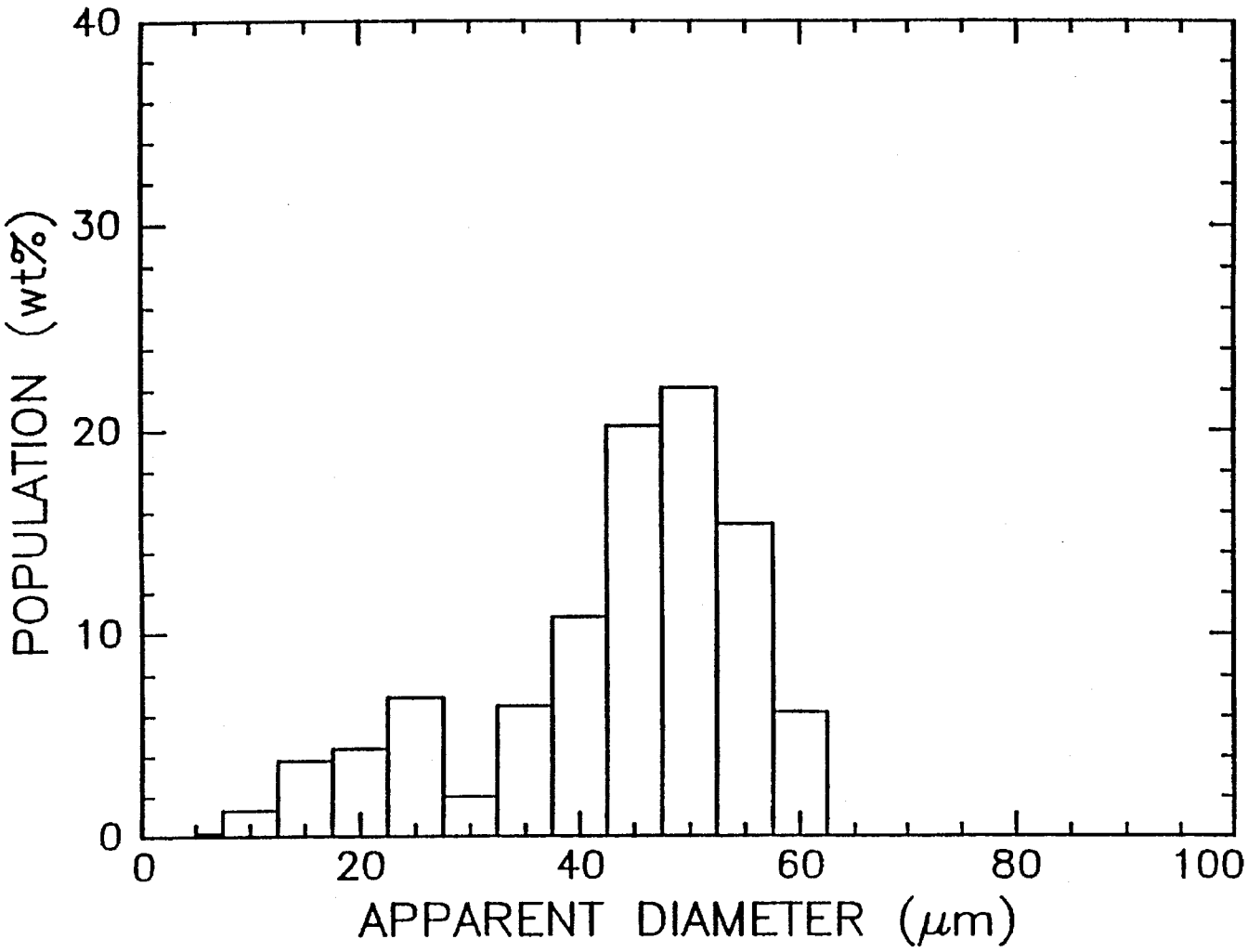
FIG. 9 is a bar graph showing the particle size distribution for the powder of Batch F in Example 2.
Figure 10:
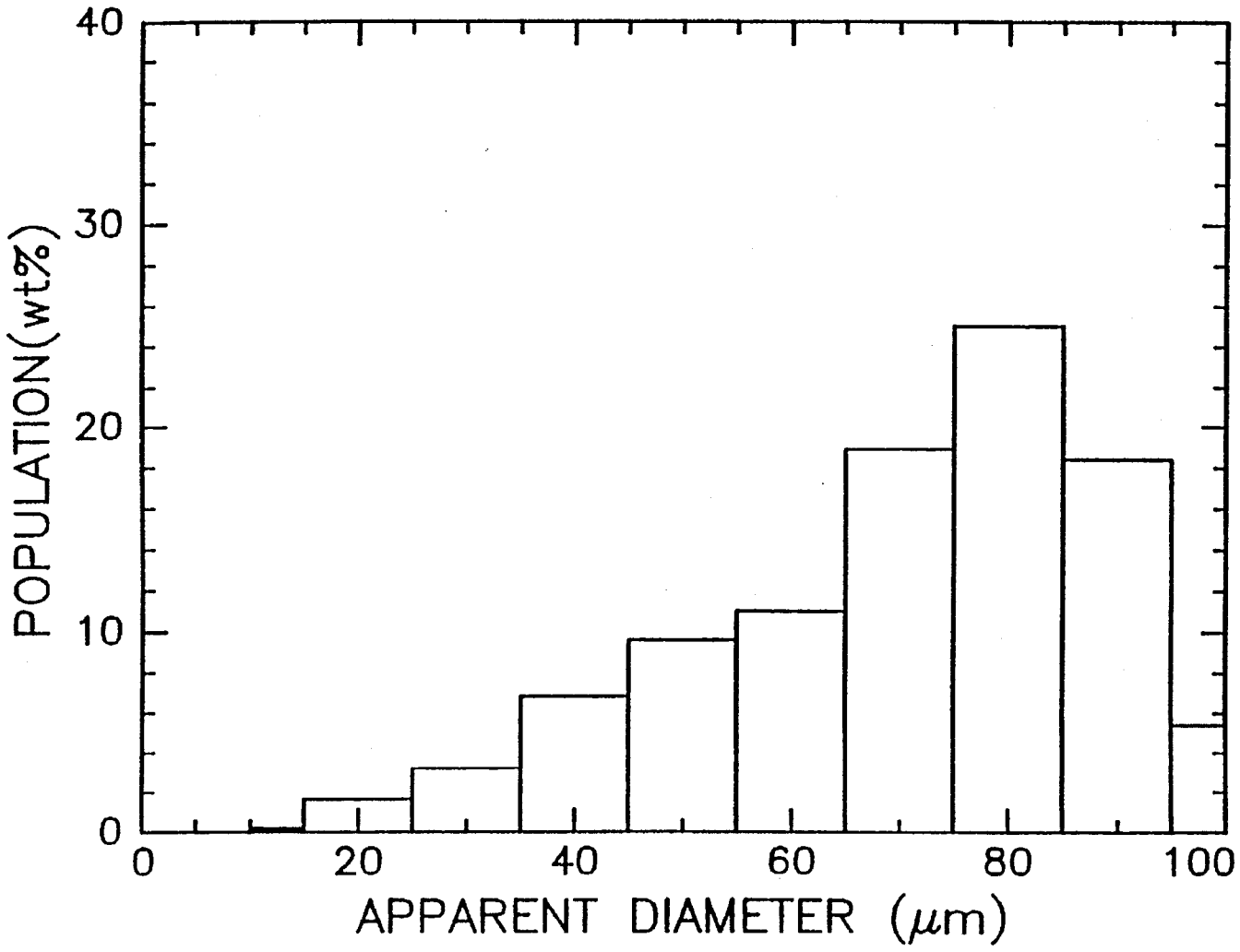
FIG. 10 is a bar graph showing the particle size distribution for the powder of Batch G in Example 2.
Figure 11:
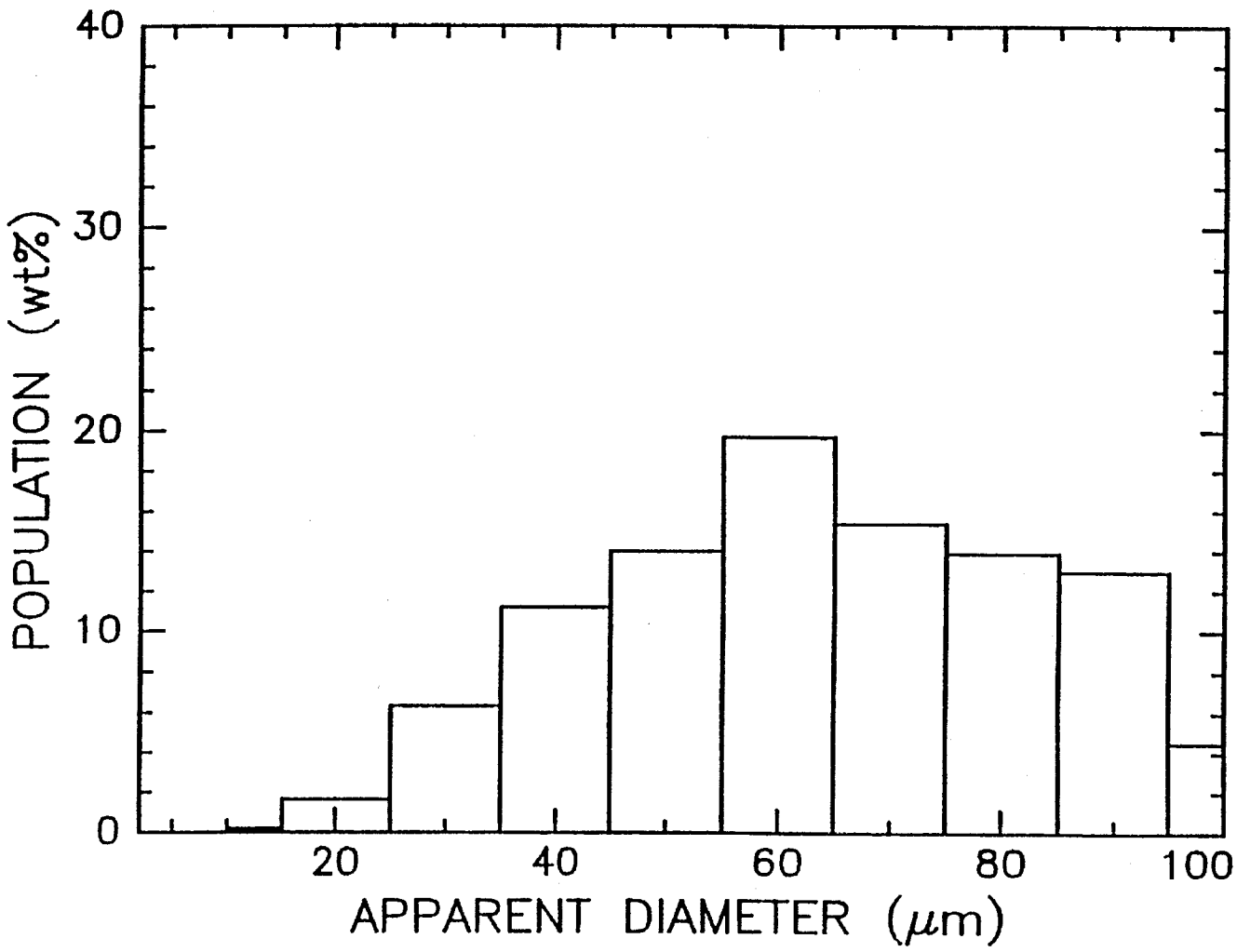
FIG. 11 is a bar graph showing the particle size distribution for the powder of Batch H in Example 2.

The average particle size of each batch was measured by optical microscopy in conjunction with an image analyzer. The average particle size of Batches A and D in the as-atomized state was about 15 microns. The average particle size of Batches B and C in the as-atomized state was about 11 microns. The particle size distributions for Batches A and D and Batches B and C are shown in FIGS. 6 and 7, respectively. Each batch was subjected to HDDR treatment for one hour at the following temperatures: 850° C., 900° C. and 950° C. The average domain size of each batch after HDDR treatment was less than 0.5 micron as determined by scanning electron microscopy under a polarized beam. The thus-formed powders were mixed with paraffin to form simulated bonded magnets. The bonded magnets were magnetically aligned by applying a D.C. magnetic field of 30 kOe during solidification of the paraffin. The intrinsic coercivity, $H_{ci}$, of the magnetically aligned bonded magnets was measured using a Walker Hysteresisgraph, Model MH-50. The measured $H_{ci}$ values for the magnetically aligned bonded magnets are shown in Table 2.

TABLE 2

| | $H_{ci}$ (kOe) | | | |
|---|---|---|---|---|
| Treatment | Batch A | Batch B | Batch C | Batch D |
| HDDR @ 850° C. | 10.4 | 8.6 | 9.7 | 9.2 |
| HDDR @ 900° C. | 15.3 | 13.8 | 12.0 | 7.3 |
| HDDR @ 1000° C. | 14.2 | 13.8 | 10.5 | 12.1 |

The bonded magnets formed of powders obtained by HDDR treatment at 900° C. were further subjected to an isothermal heat treatment in argon at 600° C. The $B_r$, $H_{ci}$, and $BH_{max}$ obtained for those magnets are shown in Table 3.

TABLE 3

| Properties | Batch A | Batch B | Batch C | Batch D |
|---|---|---|---|---|
| $B_r$ (kG) | 8.2 | 8.1 | 8.5 | 9.4 |
| $H_{ci}$ (kOe) | 15.5 | 14.7 | 12.8 | 9.0 |
| $BH_{max}$ (MGOe) | 14.5 | 13.0 | 16.0 | 15.0 |

Second quadrant demagnetization curves (with and without magnetic field alignment) for bonded magnets formed from the powder of Batch F are shown in FIG. 5. The significant difference in the demagnetization curves shows that the atomized, HDDR-treated powders of the invention are magnetically anisotropic, i.e., they respond differently when exposed to the magnetic field.

EXAMPLE 2

Four batches of atomized powders having the compositions listed in Table 4 were prepared.

TABLE 4

| | Composition (in atomic %) |
|---|---|
| Batch E | $Nd_{11.7}\ Dy_{1.3}\ Fe_{80.5}\ B_{6.5}$ |
| Batch F | $Nd_{11.7}\ Dy_{1.3}\ Fe_{80}\ Nb_{0.5}\ B_{6.5}$ |
| Batch G | $Nd_{12.6}\ Dy_{1.4}\ Fe_{79.5}\ B_{6.5}$ |
| Batch H | $Nd_{12.6}\ Dy_{1.4}\ Fe_{79}\ Nb_{0.5}\ B_{6.5}$ |

The average particle size of each batch was measured by optical microscopy in conjunction with an image analyzer. The average particle size of Batches E, F, G, and H in the as-atomized state was about 60 microns, about 45 microns, about 80 microns, and about 70 microns, respectively. The intrinsic coercivity, $H_{ci}$, of powder samples from each batch was measured under the following conditions: (1) as-atomized; (2) as-atomized with an isothermal treatment for 1.5 hours at 500° C., 600° C., and 700° C.; (3) HDDR-treated for one hour at 850° C., 900° C., and 950° C.; and (4) HDDR-treated as in (3) with an isothermal treatment for 1.5 hours at 550° C., 600° C., and 650° C. The measured $H_{ci}$ values for each sample are listed in Table 5.

TABLE 5

| | $H_{ci}$ (kOe) | | | |
|---|---|---|---|---|
| Treatment | Batch E | Batch F | Batch G | Batch H |
| As-Atomized (A—A) | 0.9 | 2.1 | 2.0 | 3.0 |
| A—A with isot @ 500° C. | 1.0 | 2.1 | 2.0 | 3.0 |
| A—A with isot @ 600° C. | 1.8 | 3.1 | 3.3 | 6.3 |
| A—A with isot @ 700° C. | 3.0 | 4.2 | 3.8 | 4.8 |
| HDDR @ 850° C. | 3.8 | 13.7 | 12.4 | 13.5 |
| HDDR @ 850° C. with isot @ 550° C. | 10.9 | 14.6 | 9.0 | 14.2 |
| HDDR @ 850° C. with isot @ 600° C. | 4.5 | 15.2 | 12.7 | 14.5 |
| HDDR @ 850° C. with isot @ 650° C. | 4.1 | 14.9 | 11.6 | 14.4 |
| HDDR @ 900° C. | 11.5 | 13.9 | 7.7 | 14.0 |
| HDDR @ 900° C. with isot @ 550° C. | 12.4 | 15.9 | 7.2 | 15.2 |
| HDDR @ 900° C. with isot @ 600° C. | 12.7 | 15.7 | 6.9 | 15.2 |
| HDDR @ 900° C. with isot @ 650° C. | 12.2 | 14.8 | 8.0 | 15.1 |
| HDDR @ 950° C. | 2.6 | 13.5 | 2.9 | 12.3 |
| HDDR @ 950° C. with isot @ 550° C. | 2.1 | 14.7 | 2.6 | 3.1 |
| HDDR @ 950° C. with isot @ 600° C. | 0.5 | 16.3 | 2.9 | 13.8 |
| HDDR @ 950° C. with isot @ 650° C. | 1.8 | 14.6 | 2.5 | 8.2 |

As shown in Table 5, the as-atomized powders of Batches E through H all exhibit an $H_{ci}$ of not greater than 3 kOe. These low $H_{ci}$ values are improved by applying an isothermal treatment at a temperature in the range of 500° C. to 700° C. to the as-atomized powders. For example, an isothermal treatment at 600° C. increased the $H_{ci}$ level for Batch H from 3.0 kOe in the as-atomized state to 6.3 kOe. A more significant increase in $H_{ci}$ is observed when the as-atomized powder is subjected to both HDDR treatment and an isothermal treatment. For example, after being HDDR-treated at 900° C. with an isothermal treatment at 550° C., the $H_{ci}$ level for Batch F is 15.9 kOe. For batches E and G, which do not contain Nb, $H_{ci}$ depends on the HDDR temperature. The $H_{ci}$ level for Batch E is optimized at 900° C. whereas the $H_{ci}$ level for Batch G is optimized at 850° C. Severe secondary recrystallization is observed in powders that have been HDDR-treated above 950° C. and, as a consequence, $H_{ci}$ significantly decreases. For Batches F and H, which contain 0.5 atomic % Nb, $H_{ci}$ is less sensitive to the HDDR temperature. Batch F can be HDDR-treated over the temperature range of 850° C. to 950° C. with a peak at 900° C. With a slight increase in Nd or total rare earth content as in Batch H, an $H_{ci}$ of more than 14 kOe was obtained when HDDR was performed at temperatures below 900° C. When HDDR was performed at 950° C., the $H_{ci}$ became very sensitive to the temperature of the isothermal treatment. An $H_{ci}$ of 13.8 kOe was obtained when the isothermal treatment was carried out at 600° C.

The $B_r$, $H_{ci}$, and $BH_{max}$ values for powder samples of Batches E through H that were HDDR-treated at 900° C. for approximately one hour and isothermally treated at 600° C. for approximately 1.5 hours are listed in Table 6.

TABLE 6

| | Batch E | Batch F | Batch G | Batch H |
|---|---|---|---|---|
| $B_r$ (kG) | 7.6 | 7.8 | 4.6 | 6.2 |
| $H_{ci}$ (kOe) | 12.7 | 15.7 | 6.9 | 15.2 |
| $BH_{max}$ (MGOe) | 8.8 | 15.5 | 5.0 | 7.5 |

The $B_r$ and $BH_{max}$ values listed in Table 6 range from 4.6 to 7.8 kG and 5.0 to 15.5 MGOe, respectively. For the most part, the $B_r$ and $BH_{max}$ values for Batches E through H in Example 2 are lower than observed for Batches A through D in Example 1. Theoretically, the alloy compositions of Batches E through H should yield higher $B_r$ and $BH_{max}$ values than the compositions of Batches A through D. The powders of Batches E through H, however, are much coarser than the powders of Batches A through D. Specifically, the average particle sizes for Batches E through H range from about 45 microns to about 80 microns whereas the average particle sizes for Batches A through D range from about 11 microns to about 15 microns. The $B_r$ and $BH_{max}$ values observed in Examples 1 and 2 demonstrate that finer particle sizes play a significant role in improving magnetic properties, particularly $B_r$ and $BH_{max}$, after HDDR treatment.

It will be apparent to those skilled in the art that various modifications and variations can be made in the method of forming a magnetically anisotropic powder, the method of forming a bonded magnet consisting essentially of magnetically anisotropic powder, and the bonded magnet of the invention without departing from the scope of the invention as defined in the following claims.

What is claimed is:

1. A method of forming a magnetically anisotropic powder, said method comprising the steps of:

forming a substantially spherical powder having a major magnetic phase and an average particle size of less than about 200 microns, said powder being comprised of at least one element from the iron group, at least one rare earth element, and boron;

diffusing hydrogen into said powder at elevated temperatures in an amount sufficient to disproportionate said major magnetic phase to yield a disporportionated powder; and desorbing said hydrogen by heating the disporportionated powder under vacuum to yield a dehydrogenated powder.

2. The method of claim 1, further comprising the step of:

heating the dehydrogenated powder to increase the intrinsic coercivity of the powder.

3. The method of claim 1, wherein the disproportionated powder maintains the original size and the substantially spherical shape of the as-formed powder.

4. The method of claim 1, wherein said element from the iron group is selected from the group consisting of Fe, Ni, Co, and mixtures thereof.

5. The method of claim 4, wherein said rare earth element is selected from the lanthanide group consisting of Nd, La, Sm, Pt, Dy, Tb, Ho, Er, Tm, Yb, Lu, Y, mixtures thereof, and mischmetal.

6. The method of claim 5 wherein said major magnetic phase consists essentially of $(Nd_{1-x}R_x)_2 Fe_{14}B$, where R is one or more of La, Sm, Pr, Dy, Tb, Ho, Er, Tm, Yb, Lu, and Y, and x is from 0 to 1.

7. The method of claim 6, wherein said major magnetic phase consists essentially of tetragonal $Nd_2Fe_{14}B$.

8. The method of claim 7, wherein said powder contains at least one refractory element selected from the group consisting of Co, Nb, V, Mo, Ti, Zr, Cr, W, and mixtures thereof to minimize the secondary recrystallization of $Nd_2Fe_{14}B$ grains.

9. The method of claim 6, wherein the steps of diffusing hydrogen and desorbing hydrogen are carried out at a temperature in the range from about 900° C. to about 950° C.

10. The method of claim 6, wherein said powder contains at least one grain boundary modifier selected from the group consisting of Cu, Al, and Ga to increase the coercivity of said powder.

11. The method of claim 1, wherein the steps of diffusing hydrogen and desorbing hydrogen are carried out at elevated temperatures in the range from 500° C. to 1000° C.

12. The method of claim 1, further comprising the step of:

subjecting the dehydrogenated powder to a magnetic field to form a magnetic powder wherein said magnetic powder has an intrinsic coercivity greater than about 7 kOe.

13. The method of claim 1, wherein the step of forming said substantially spherical powder comprises inert gas atomization.

14. The method of claim 1, wherein said substantially spherical powder has an average particle size of less than about 150 microns.

15. The method of claim 1, wherein said substantially spherical powder has an average particle size in the range from about 10 microns to about 150 microns.

16. The method of claim 1, wherein said substantially spherical powder has an average particle size in the range from about 10 microns to about 70 microns.

17. A method of forming a bonded magnet consisting essentially of magnetically anisotropic powder, said method comprising the steps of:

forming a substantially spherical powder having a major magnetic phase and an average particle size of less than about 200 microns by inert gas atomization, said powder being comprised of at least one element from the iron group, at least one rare earth element, and boron;

diffusing hydrogen into said substantially spherical powder at elevated temperatures in an amount sufficient to disproportionate said major magnetic phase;

desorbing said hydrogen by heating the disproportionated powder under vacuum;

mixing the dehydrogenated powder with a suitable binder to form a mixture comprised of powder particles dispersed in said binder; and aligning and magnetizing the powder particles in said mixture in a magnetic field.

18. The method of claim 17, wherein after the desorbing step and before the mixing step, the method further comprises the step of:

heating the dehydrogenated powder to increase the intrinsic coercivity of the powder.

19. The method of claim 17, wherein the disproportionated powder maintains the substantially spherical shape and average particle size of less than about 200 microns of the as-atomized powder.

20. The method of claim 17, wherein said substantially spherical powder has an average particle size of less than about 150 microns.

21. The method of claim 17, wherein said substantially spherical powder has an average particle size in the range from about 10 to about 70 microns.

22. A method of forming a magnetically anisotropic powder, said method comprising the steps of:

forming a substantially spherical powder having a major magnetic phase and an average particle size in the range from about 10 microns to about 70 microns, said powder being comprised of at least one element from the iron group, at least one rare earth element, and boron;

diffusing hydrogen into said powder at elevated temperatures in an amount sufficient to disproportionate said major magnetic phase to yield a disproportionated powder, the disporportionated powder maintaining the substantially spherical shape and average particle size in the range from about 10 microns to about 70 microns of the as-formed powder; and desorbing said hydrogen by heating the disporportionated powder under vacuum.

* * * * *